United States Patent [19]

Abe

[11] 4,258,678

[45] Mar. 31, 1981

[54] CONTROL APPARATUS FOR GLOW PLUGS PROVIDED FOR A DIESEL ENGINE

[75] Inventor: Yoshiaki Abe, Higashimatsuyama, Japan

[73] Assignee: Diesel Kiki Co., Ltd., Tokyo, Japan

[21] Appl. No.: 14,165

[22] Filed: Feb. 22, 1979

[30] Foreign Application Priority Data

Feb. 22, 1978 [JP] Japan ..... 53-018601

[51] Int. Cl.[3] ..... F02P 19/02

[52] U.S. Cl. ..... 123/179 H; 123/179 BG; 123/145 A

[58] Field of Search ..... 123/179 BG, 145 A, 179 B, 123/179 H

[56] References Cited

U.S. PATENT DOCUMENTS

| | | | |
|---|---|---|---|
| 2,606,544 | 8/1952 | Church et al. | 123/145 A |
| 3,675,033 | 7/1972 | Richard et al. | 123/145 A |
| 4,088,109 | 5/1978 | Woodruff et al. | 123/179 B |
| 4,137,885 | 2/1979 | Van Ostrom | 123/179 H |

FOREIGN PATENT DOCUMENTS

| | | | |
|---|---|---|---|
| 2205108 | 11/1972 | Fed. Rep. of Germany | 123/179 BG |
| 2617410 | 11/1977 | Fed. Rep. of Germany | 123/179 BG |
| 2822760 | 12/1978 | Fed. Rep. of Germany | 123/145 A |

*Primary Examiner*—Charles J. Myhre
*Assistant Examiner*—Andrew M. Dolinar
*Attorney, Agent, or Firm*—Birch, Stewart, Kolasch & Birch

[57] ABSTRACT

Control apparatus for glow plugs provided for a diesel engine having a control circuit arrangment for controlling the supply of an electric current from a battery to the glow plugs in response to the temperature condition of the diesel engine. When the engine is cold, the supply of the electric current lasts until a predetermined temperature of the glow plugs is attained. After attainment of the predetermined temperature of the glow plugs, a low level electric voltage is applied to the glow plugs so as the maintain the predetermined temperature thereof. When the engine is warmed up, the supply of an electric heating current to the glow plugs is commenced at the same time as the starting operation of the diesel engine.

4 Claims, 1 Drawing Figure

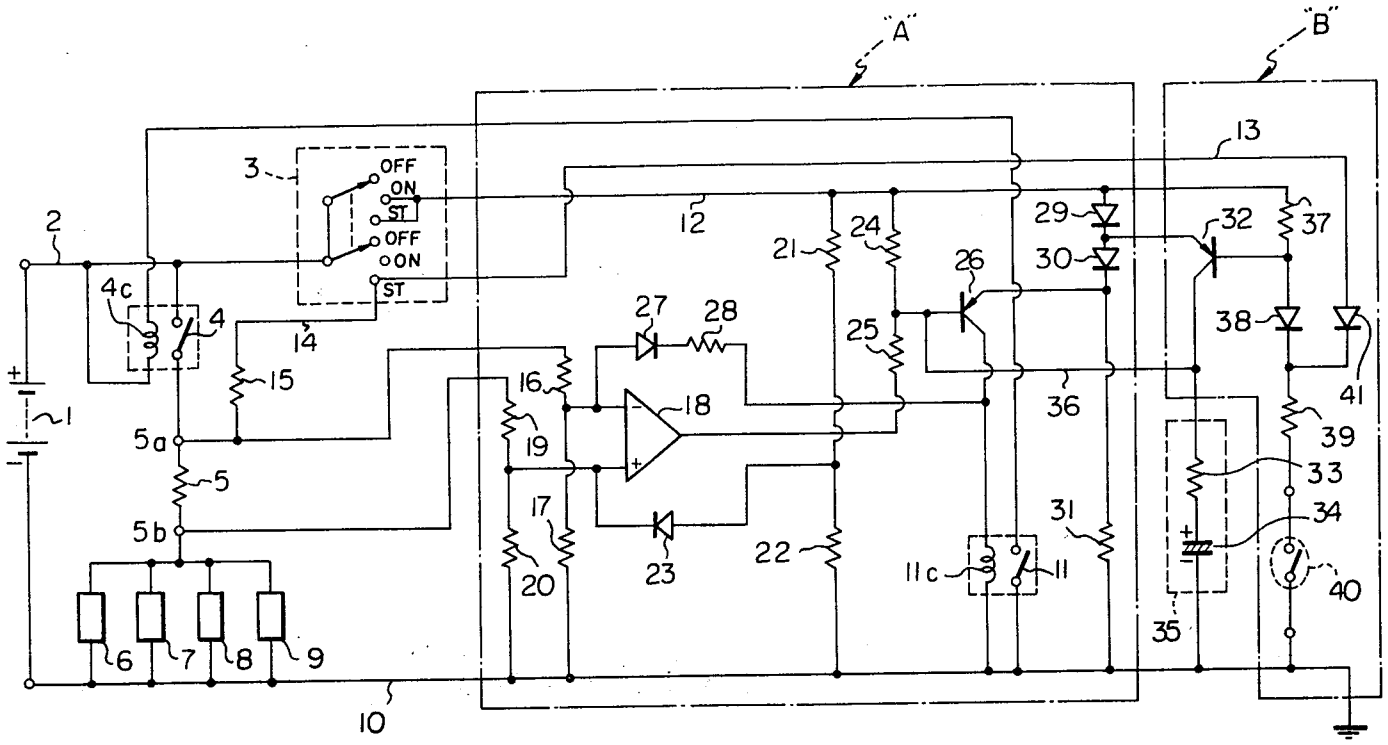
"B"
"A"
OFF
ON
ST
OFF
ON
ST

CONTROL APPARATUS FOR GLOW PLUGS PROVIDED FOR A DIESEL ENGINE

FIELD OF THE INVENTION

The present invention relates to a control apparatus for glow plugs or heating plugs equipped for enabling the starting of diesel engines driving automobiles.

BACKGROUND OF THE INVENTION

With a diesel engine driving an automobile, it is usually necessary to heat up glow plugs to a high temperature of, for example, eight hundred degrees centigrade which is suitable for quickly starting the diesel engine, prior to performing the starting operation of the engine by means of a known starter motor. However, under certain environmental temperature conditions of a diesel engine, for example, under a condition where the diesel engine per se is sufficiently warmed up, it is possible to start the heating of the glow plugs at the same time as operating the starter motor which operation is performed by shifting a key switch to a starting position thereof.

A conventional control apparatus for glow plugs disclosed in, for example, U.S. Pat. No. 3,675,033 belonging to Richard et al does not always take such environmental temperature condition of a diesel engine into consideration for achieving control of the heating of glow plugs.

SUMMARY OF THE INVENTION

An object of the present invention is to provide a control apparatus for heating glow plugs provided for enabling the starting of a diesel engine, in which apparatus electric control circuits are arranged so that the supply of an electric heating current to glow plugs is controlled depending upon the temperature condition of the diesel engine.

The present invention provides a control apparatus for glow plugs whereby when a diesel engine is cold, the supply of an electric heating current from an electric source to the glow plugs is immediately commenced by moving a key switch from an OFF position to an ON position, and lasts until the glow plugs are fully heated to a predetermined temperature level. When the predetermined temperature level of the glow plugs is attained, the supply of the electric heating current is prohibited. Thereafter, when the key switch is moved to a starting position thereof, a reduced electric voltage is applied to the glow plugs so that a low level electric heating current is supplied to the glow plugs. Thus, excess heating of the glow plugs can be prevented. Furthermore, when the diesel engine is in a warmed-up condition, the electric heating current supply to the glow plugs is prohibited even if the key switch is moved from the OFF position to the ON position. When the key switch is further moved to the starting position from the ON position, the supply of electric heating current to the glow plugs occurs. Therefore, the control apparatus of the present invention is provided with means for sensing the temperature condition of a diesel engine so that when the warmed-up condition of the diesel engine is sensed, the electric heating current supply to the glow plugs is automatically prohibited.

The present invention will become more apparent from the ensuing description with reference to the accompanying drawing wherein:

The single FIGURE illustrates an electric control circuit arrangement embodying the control apparatus of the present invention.

Referring to the drawing, an electrically conductive line 2 running from a positive pole of a battery 1 of an automobile is connected to one end of a key switch 3, one end of a normally open relay switch 4 and to one end of a relay coil **4*c* of the relay switch 4. The other end of the relay switch 4 is connected to one end of each of glow plugs 6, 7, 8, and 9 via an electric resistor 5. The glow plugs 6, 7, 8 and 9 are respectively provided for each of the combustion chambers of a diesel engine. Therefore, the present embodiment shows, by way of example, a case where the diesel engine is of the type having four cylinders provided with a combustion chamber, respectively. The other end of each of glow plugs 6, 7, 8 and 9 is connected to a grounded conductive line 10 which is connected to a negative pole of the battery 1. The other end of the relay coil 4*c* is also connected to the grounded conductive line 10 via a normally open relay switch 11. The key switch 3 has two movable ends which are respectively moved from an OFF position to an ON position and a starting position designated by ST. The one ON position and the one ST position are commonly connected to an electrically conductive line 12, while the other ST position is connected to both electrically conductive lines 13 and 14. The line 14 is connected to a connecting point of the relay switch 4 and the resistor 5, via an electric resistor 15 for a voltage drop. The circuit arrangement enclosed by dash lines and designated by "A" constitutes a circuit portion for detecting the temperature of the glow plugs 6 through 9. The temperature detecting circuit portion includes electric resistors 16 and 17 which are arranged in series between one end 5*a* of the resistor 5 and the grounded conductive line 10. The connecting point of the two resistors 16 and 17 is connected to the negative input terminal of a comparator 18. Two electric resistors 19 and 20 are arranged in series between the other end 5*b* of the resistor 5 and the grounded conductive line 10. The connecting point of the resistors 19 and 20 is connected to the positive input terminal of the comparator 18. The positive input terminal of the comparator 18 is also connected, via a diode 23, to the connecting point of two electric resistors 21 and 22 which are arranged in series between the conductive lines 10 and 12. Electric resistors 24 and 25 are arranged in series between the conductive line 12 and the output terminal of the comparator 18. The connecting point of the resistors 24 and 25 is connected to the base terminal of a transistor 26. The collector terminal of the transistor 26 is connected to the grounded conductive line 10 via a relay coil 11*c* of the afore-mentioned relay switch 11. The connecting point of the collector terminal of the transistor 26 and the relay coil 11*c* is connected to the negative input terminal of the afore-mentioned comparator 18, via a diode 27 and an electric resistor 28 which are arranged in series. Diodes 29 and 30 and an electric resistor 31 are arranged in series between the conductive line 12 and the grounded conductive line 10. The connecting point of the diode 30 and the resistor 31 is connected to the emitter teminal of the transistor 26. Further, the connecting point of the two diodes 29 and 30 is connected to the emitter terminal of a transistor 32 of which the collector terminal is connected to the grounded conductive line 10, via a trigger circuit 35 consisting of an electric resistor 33 and a capacitor 34 connected in series to one another. The base terminal of the transistor 26 and the collector terminal of the transistor 32 are interconnected by an electrically conductive line 36. An electric resistor 37, a diode 38, an electric resistor 39 and a temperature sensing switch 40 which senses the temperature of a cooling water of a diesel engine are arranged in series between the conductive lines 10 and 12. The connecting point of the resistor 37 and the diode 38 is connected to the base terminal of the transistor 32. It should be appreciated that the switch 40 is arranged so as to become ON when the temperature of the cooling water of the diesel engine reaches a predetermined high level. The conductive line 13 running from the ST position of the key switch 3 is connected to the connecting point of the diode 38 and the resistor 39, via a diode 41. It should be noted that the circuit arrangement enclosed by dash lines and designated by "B" constitutes a circuit portion for prohibiting the supply of an electric current to the glow plugs 6 through 9** when the diesel engine is fully warmed up.

In the above-described control circuit arrangement, when the switch 40 is in the OFF position, that is, when the diesel engine is cold, moving the key switch to the ON position from the OFF position causes passage of an electric current from the battery 1 to the trigger circuit 35 via the resistor 24 so as to charge the capacitor 34 of said trigger circuit. As a result, the transistor 26 becomes ON thereby energizing the relay coil 11*c* of the relay switch 11. Consequently, the relay switch 11 is closed and becomes ON. Thus, the relay coil 4*c* of the relay switch 4 is energized so as to close the switch 4. As a result, an electric voltage is applied from the battery 1 to the glow plugs 6 through 9 via the resistor 5 having a small thermal coefficient. The glow plugs 6 through 9 consist of an electric resistance element having a positive thermal coefficient, respectively. A typical embodiment of the electric resistance element is a heating element constructed of nickel having an electric resistance of 0.1 ohm at normal ambient temperature. The electric resistance of the resistor 5 is selected to be approximately 0.007 ohm. Therefore, when the electric voltage is applied to the glow plugs 6 through 9, the glow plugs are quickly heated and accordingly, the electric resistance of each of the glow plugs 6 through 9 is increased. In response to the increase in the electric resistance of each of the glow plugs 6 through 9, the electric potential of the point 5*b* gradually rises. When the electric resistance of each of the glow plugs 6 through 9 reaches a value corresponding to approximately eight hundred degrees centigrade of the surface temperature of each of the glow plugs 6 through 9, the output of the comparator 18 varies from a low level to a high level, since the electric resistances of the resistors 16, 17, 19 and 20 are selected so as to cause such variation of the level of the output of the comparator 18. The high level output from the comparator 18 forces the transistor 26 to become OFF. As result, the relay switch 11 as well as the relay switch 4 become OFF, so that the supply of electric current from the battery 1 to the glow plugs 6 through 9 is prohibited. As soon as the supply of the electric current to the glow plugs is prohibited, a small positive electric voltage is applied to the positive input terminal of the comparator 18 by a bias circuit consisting of the resistors 21 and 22 and the diode 23. Therefore, the high level of the output from the comparator 18 is maintained. Consequently, the prohibition of the supply of the electric current to the glow plugs continues. Thus, at the next stage, when an indicating lamp (not shown) indicates that the heating up of the glow plugs 6 through 9 is completed, the key switch 3 is moved by an operator to the ST position from the ON position. Therefore, the known starter motor for a diesel engine is operated and at the same time, a low level of an electric voltage is applied to the glow plugs 6 through 9 from the battery 1 via the resistor 15. It should be understood that the electric resistance of the resistor 15 is selected so that the surface temperature of the glow plugs is maintained at eight hundred degrees centigrade. However, if the surface temperature of the glow plugs 6 through 9 is considerably reduced from eight hundred degrees centigrade, for example, if said surface temperature becomes lower than six hundred degrees centigrade, the temperature detecting circuit portion "A" operates so that the output from the comparator 18 varies from the high level to the low level. As a result, the relay switch 4 becomes ON and accordingly, the glow plugs 6 through 9 are immediately and quickly heated up. Thus, when the surface temperature of the glow plugs 6 through 9 is restored to eight hundred degrees centigrade, the relay switch 4 becomes OFF so that only a low level of electric voltage is applied to the glow plugs 6 through 9 via the resistor 15. As a result, the surface temperature of the glow plugs 6 through 9 is maintained at eight hundred degrees centigrade.

On the other hand, when a diesel engine is fully warmed up, moving of the key switch 3 from the OFF position to the ON position does not cause the heating operation of the glow plugs 6 through 9. That is to say, when the diesel engine is warmed up, the water temperature sensing switch 40 of the circuit "B" becomes ON, so that the transistor 32 becomes ON. As a result, the transistor 26 is forced to become OFF. Accordingly, the relay switch 4 becomes OFF. Therefore, the supply of the electric heating current from the battery 1 to the glow plugs 6 through 9 is prohibited. Thereafter, when the key switch 3 is moved from the ON position to the ST position, the transistor 32 becomes OFF irrespective of the water temperature sensing switch 40 being ON, since the diode 41 is arranged in the electrically conductive line 13. As a result, the transistor 26 becomes ON. Accordingly, the relay switch 4 is closed so that the electric heating current is supplied from the battery 1 to the glow plugs 6 through 9. Thus, the glow plugs 6 through 9 are quickly heated up to eight hundred degrees centigrade. Therefore, the output from the comparator 18 varies from the low level to the high level. This variation in the output level from the comparator 18 causes the transistor 26 to become OFF. Thus, the relay switch 4 becomes OFF. As a result, the glow plugs 6 through 9 are supplied with an electric heating current from the battery 1 via the resistor 15. Consequently, the surface temperature of the glow plugs 6 through 9 is maintained at eight hundred degrees centigrade.

From the foregoing description, it will be understood that in the control apparatus of the present invention, the glow plugs are supplied with an electric heating current of which the level is changed in response to the temperature condition of a diesel engine. Furthermore, when the glow plugs are heated up to a predetermined temperature level suitable for starting the diesel engine, the electric voltage level applied to the glow plugs is reduced by moving the key switch from the ON position to the ST position. Therefore, not only can the surface temperature of the heating plugs be maintained at the predetermined level, but also excess supply of an electric heating current to the glow plugs can be prohibited. This fact prevents the glow plugs from being cut. Furthermore, the operating of the control apparatus of the present invention can be performed by moving the key switch from the OFF position thereof to the ON position or the ST position. Therefore, an operator who is accustomed to the operation of a gasoline engine, can easily operate a diesel engine equipped with the control apparatus of the present invention. This fact means that a diesel engine equipped with the control apparatus for heating the glow plugs according to the present invention is very effective for mounting on automobiles.

Obviously, modifications and variations of the present invention are possible in light of the above teachings. It is therefore to be understood that within the scope of the appended claims the present invention may be practiced other than as specifically described.

What is claimed is:

1. A control apparatus for glow plugs provided in a diesel engine, comprising:

an electric source for supplying an electric current;

relay switch means arranged between said electric source and said glow plugs, and having a normally open contact;

first electric circuit means for applying a predetermined level of an electric voltage from said electric source to said glow plugs via said normally open contact of said relay switch means;

key switch means having an OFF position, an ON position and a Starting Position, said key switch means being connected to said electric source;

an electric resistor element connected between said Starting Position of said key switch means and said glow plugs;

second electric circuit means for applying a low level of said electric voltage from said electric source to said glow plugs via said Starting Position of said key switch means and said electric resistor element, said first and second electric circuit means being arranged in parallel with one another;

temperature detecting circuit means for detecting a predetermined temperature level of said glow plugs, said temperature detecting circuit means being operated when said key switch means is moved from said OFF position to said ON position and to said Starting Position; and prohibiting circuit means for prohibiting a supply of said electric current from said electric source to said glow plugs, said prohibiting circuit means including a thermal sensing switch means for sensing the temperature of the diesel engine, said prohibiting circuit means being operated when said key switch means is moved to said ON position and when said thermal sensing switch means senses a warmed up condition of said diesel engine, said normally open contact of said relay switch means being forcedly maintained at an open position when said thermal sensing switch means senses the warmed-up condition of said diesel engine.

2. A control apparatus for glow plugs provided in a diesel engine, comprising:

an electric source for supplying an electric voltage and and electric current;

relay switch means arranged between said electric source and said glow plugs, and having a normally open contact;

first electric circuit means for applying a predetermined level of an electric voltage from said electric source to said glow plugs via said relay switch means, said glow plugs including a plurality of electric resistor elements, each of said elements having a resistance which varies in accordance with a surface temperature of said glow plugs;

key switch means having three switching positions including an OFF, an ON and a Starting Position, said key switch means being connected to said electric source;

second electric circuit means for applying a low level of said electric voltage from said electric source to said glow plugs via the Starting Position of said key switch means, the first and second electric circuits being arranged in parallel with one another;

temperature detecting circuit means for detecting a predetermined temperature level of said glow plugs, said temperature detecting circuit means including, a comparator circuit means responsive to a first electric voltage developed by said plurality of electric resistor elements, said first electric voltage being developed in response to changes in the surface temperature of said glow plugs, said comparator circuit means being responsive to a second electric voltage corresponding to a predetermined reference temperature, and an electromagnetic relay for opening and closing said normally open contact of said relay switch means in response to an output from said comparator circuit means, said temperature detecting circuit means being operated when said key switch means is moved from said OFF position to said ON position and to said Starting Position; and prohibiting circuit means for prohibiting the supply of said electric current to said glow plugs, said prohibiting circuit means including a thermal sensing switch means for sensing a temperature condition of said diesel engine, said prohibiting circuit means being operated when said key switch means is moved to said ON position and when said thermal sensing switch means senses that said diesel engine is warmed up, said normally open contact being forcedly maintained at an open state in response to the sensed condition of said thermal sensing switch means.

3. Control apparatus according to claim 2, wherein said temperature detecting circuit means further comprises a bias circuit for applying a predetermined level of an electric voltage to one input terminal of said comparator circuit.

4. Control apparatus according to claim 2, further comprising a trigger circuit means responsive to actuation of said key switch means to said ON position for operating said electromagnetic relay so as to operate said temperature detecting circuit, said trigger circuit comprising an electric resistor element and a capacitor.

* * * * *